US010061243B2

(12) United States Patent
Ohshima

(10) Patent No.: US 10,061,243 B2
(45) Date of Patent: Aug. 28, 2018

(54) FIXING DEVICE AND IMAGE FORMING APPARATUS INCORPORATING SAME

(71) Applicant: Hironori Ohshima, Kanagawa (JP)

(72) Inventor: Hironori Ohshima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/621,370

(22) Filed: Jun. 13, 2017

(65) Prior Publication Data

US 2018/0004137 A1 Jan. 4, 2018

(30) Foreign Application Priority Data

Jun. 29, 2016 (JP) ..... 2016-129176

(51) Int. Cl.

*G03G 15/00* (2006.01)
*G03G 15/20* (2006.01)
*G03G 15/01* (2006.01)

(52) U.S. Cl.

CPC ..... *G03G 15/2067* (2013.01); *G03G 15/2025* (2013.01); *G03G 15/2089* (2013.01);
(Continued)

(58) Field of Classification Search

CPC ..... G03G 15/2064; G03G 15/2025; G03G 15/04; G03G 2215/0129; G03G 2215/2032; G03G 21/0041
See application file for complete search history.

(56) References Cited

U.S. PATENT DOCUMENTS 4,939,552 A * 7/1990 Nakanishi ..... G03G 15/04 399/320
5,559,591 A * 9/1996 Kato ..... G03G 15/2025 15/256.51

(Continued)

FOREIGN PATENT DOCUMENTS

JP 62-028780 2/1987
JP 2-162376 6/1990

(Continued)

OTHER PUBLICATIONS

European Search Report dated Nov. 20, 2017 issued in corresponding European Application No. 17178126.3.

*Primary Examiner* — Clayton E Laballe
*Assistant Examiner* — Ruifeng Pu
(74) *Attorney, Agent, or Firm* — Harness, Dickey & Pierce, P.L.C.

(57) ABSTRACT

A fixing device includes a fixing rotator, a pressure rotator, and a cleaning device. The cleaning device cleans a surface of at least one of the fixing rotator and the pressure rotator. The cleaning device includes a cleaning web, a web holder, a winder, a cleaning pressure rotator, a pressure applier, and a temporary holder. The cleaning web slides over and cleans the at least one of the fixing rotator and the pressure rotator. The web holder holds and sends out the cleaning web. The winder winds the cleaning web. The cleaning pressure rotator presses the cleaning web against the at least one of the fixing rotator and the pressure rotator. The pressure applier presses against the cleaning web along a width direction of the cleaning web perpendicular to a direction in which the cleaning web is wound. The temporary holder temporarily holds the pressure applier.

8 Claims, 7 Drawing Sheets

(52) U.S. Cl.
CPC ..... *G03G 15/2092* (2013.01); *G03G 15/0168* (2013.01); *G03G 15/652* (2013.01); *G03G 2215/00708* (2013.01); *G03G 2215/2035* (2013.01)

(56) References Cited

U.S. PATENT DOCUMENTS 5,848,341 A * 12/1998 Watanabe ..... G03G 21/0041 15/256.5
5,943,542 A * 8/1999 Dalal ..... G03G 15/2025 399/325
7,433,638 B2 * 10/2008 Ide ..... G03G 21/0041 399/327
2008/0226315 A1 * 9/2008 Yamanaka ..... G03G 15/2025 399/45
2009/0067865 A1 * 3/2009 Kitami ..... G03G 15/2025 399/67
2011/0008081 A1 * 1/2011 Aoyama ..... G03G 15/2096 399/327
2014/0029992 A1 * 1/2014 Yamamoto ..... G03G 15/2064 399/328
2015/0220045 A1 * 8/2015 Hatazaki ..... G03G 21/0041 399/327
2015/0286172 A1 * 10/2015 Hosokawa ..... G03G 15/2025 399/327
2016/0124357 A1 * 5/2016 Ujiie ..... G03G 15/2025 399/327
2016/0306311 A1 * 10/2016 Ono ..... G03G 15/2064
2017/0108805 A1 * 4/2017 Nojima ..... G03G 15/2025

FOREIGN PATENT DOCUMENTS

JP 5-241448 9/1993
JP H10-288908 A 10/1998
JP 2001-042687 A 2/2001
JP 2002-244372 8/2002
JP 2006-220888 A 8/2006
JP 2012-042546 3/2012

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2016-129176, filed on Jun. 29, 2016, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image onto a recording medium, and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator.

In such a fixing device, toner melting at the fixing nip may partly adhere to the surface of at least one of the fixing rotator and the pressure rotator. To address this circumstance, the fixing device often includes a cleaning mechanism to remove the toner from the at least one of the fixing rotator and the pressure rotator, thus cleaning the surface of the at least one of the fixing rotator and the pressure rotator.

SUMMARY

In one embodiment of the present disclosure, a novel fixing device is described that includes a fixing rotator, a pressure rotator, and a cleaning device. The pressure rotator contacts the fixing rotator to form a fixing nip between the fixing rotator and the pressure rotator, through which a recording medium bearing a toner image is conveyed. The cleaning device cleans a surface of at least one of the fixing rotator and the pressure rotator. The cleaning device includes a cleaning web, a web holder, a winder, a cleaning pressure rotator, a pressure applier, and a temporary holder. The cleaning web slides over the at least one of the fixing rotator and the pressure rotator to clean the surface of the at least one of the fixing rotator and the pressure rotator. The web holder holds and sends out the cleaning web. The winder winds the cleaning web. The cleaning pressure rotator presses the cleaning web against the at least one of the fixing rotator and the pressure rotator. The pressure applier presses against the cleaning web along a width direction of the cleaning web perpendicular to a direction in which the cleaning web is wound. The temporary holder temporarily holds the pressure applier.

Also described is a novel image forming apparatus incorporating the fixing device.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
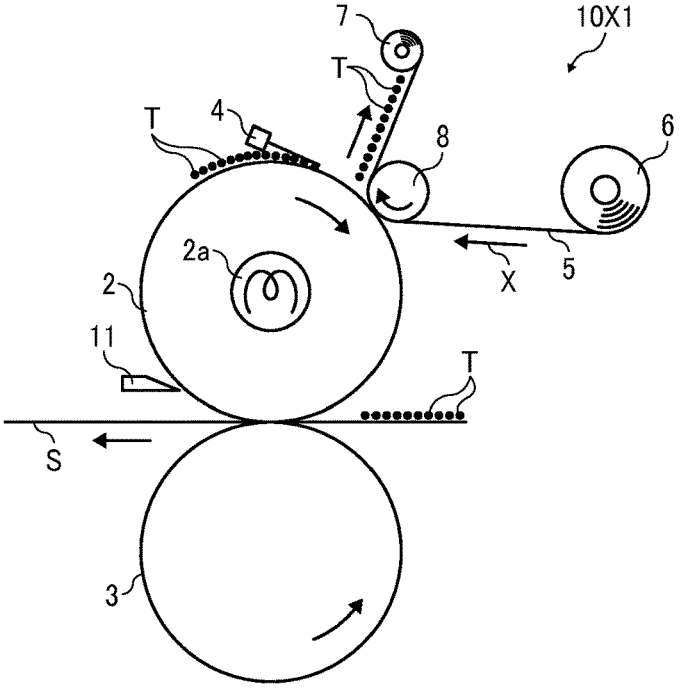
FIG. 1 is a schematic view of a first example of a comparative cleaning mechanism incorporated in a fixing device.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

Referring now to the drawings, embodiments of the present disclosure are described below.

Figure 2:
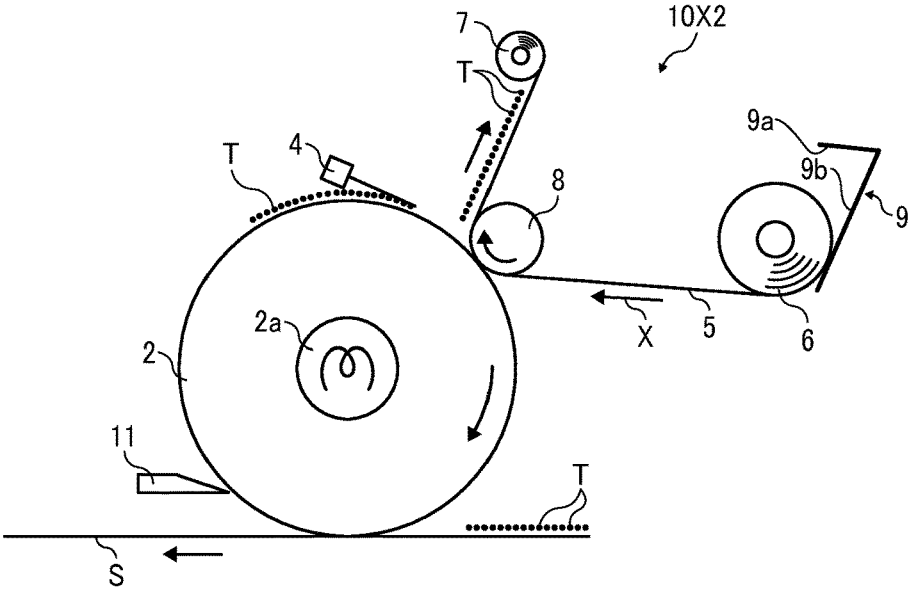
FIG. 2 is a schematic view of a second example of the comparative cleaning mechanism incorporated in the fixing device.

Initially with reference to FIGS. 1 and 2, a description is given of examples of a comparative cleaning mechanism incorporated in a fixing device.

FIG. 1 is a schematic view of a cleaning mechanism 10X1 as a first example of the comparative cleaning mechanism. FIG. 2 is a schematic view of a cleaning mechanism 10X2 as a second example of the comparative cleaning mechanism.

A fixing device illustrated in FIGS. 1 and 2 includes, e.g., a fixing roller 2 as a fixing rotator and a pressure roller 3 as a pressure rotator. A heater 2*a* is disposed inside the fixing roller 2. The pressure roller 3 contacts and presses against the fixing roller 2 to form an area of contact, herein referred to as a fixing nip, between the fixing roller 2 and the pressure roller 3. While a sheet S as a recording medium bearing a toner image is conveyed through the fixing nip, the fixing roller 2 and the pressure roller 3 apply heat and pressure to the sheet S, melting toner T contained in the toner image and fixing the toner image onto the sheet S. The fixing roller 2 having an endless surface rotates in a given direction to heat and fix the toner image onto the sheet S. The pressure roller 3 having an endless surface rotates in a given direction and presses against the fixing roller 2 to form the fixing nip. Thus, the fixing roller 2 and the pressure roller 3 apply heat and pressure to the sheet S to fix the toner image onto the sheet S at the fixing nip.

A part of the toner T melting at the fixing nip may fail to be fixed onto the sheet S and adhere to the surface of the fixing roller 2. This phenomenon is called an offset.

The toner T adhering to the surface of the fixing roller 2 at the fixing nip moves as the fixing roller 2 rotates. The toner T transferred to the fixing roller 2 from the sheet S by the offset may contaminate components that contact the fixing roller 2, such as a sheet separation claw 11, a temperature sensor 4, and the pressure roller 3. The temperature sensor 4 detects a surface temperature of the fixing roller 2. The toner T adhering to the surface of the fixing roller 2 may adhere to and contaminate a next sheet S conveyed through the fixing nip.

To address these circumstances, the fixing device incorporates the cleaning mechanism 10X1 of FIG. 1, for example. The cleaning mechanism 10X1 includes a cleaning member that is pressed against the fixing roller 2 at a given pressure to remove the toner T from the surface of the fixing roller 2. Thus, the cleaning mechanism 10X1 cleans the surface of the fixing roller 2.

Specifically, the cleaning mechanism 10X1 includes, e.g., a cleaning web 5, a web holder 6, a web roller 7, and a cleaning pressure roller 8. The cleaning web 5 slides over the surface of the fixing roller 2 to clean the surface of the fixing roller 2. The web holder 6 holds and sends out the cleaning web 5. The web roller 7 is a winder that winds the cleaning web 5. The cleaning pressure roller 8 is a cleaning pressure rotator that presses the cleaning web 5 against the fixing roller 2, thereby forming an area of contact, herein referred to as a web nip, between the cleaning web 5 and the fixing roller 2. The web holder 6 sends out the cleaning web 5 in a direction X as illustrated in FIG. 1. In other words, the web roller 7 winds the cleaning web 5 in the direction X.

The web roller 7 is timed to rotate to wind the cleaning web 5 in the direction X. As the web roller 7 winds the cleaning web 5, a new portion (i.e., a portion yet to contact the fixing roller 2) of the cleaning web 5 gradually moves from the web holder 6 to the web nip between the cleaning web 5 and the fixing roller 2. Thus, the cleaning web 5 of the cleaning mechanism 10X1 removes the toner T from the surface of the fixing roller 2.

However, if the cleaning web 5 waves or is wrinkled, the web nip between the cleaning web 5 and the fixing roller 2 may be secured insufficiently, degrading cleaning performance.

To address this circumstance, the fixing device may incorporate the cleaning mechanism 10X2 of FIG. 2. Like the cleaning mechanism 10X1, the cleaning mechanism 10X2 includes, e.g., the cleaning web 5, the web holder 6, the web roller 7, and the cleaning pressure roller 8. In addition, the cleaning mechanism 10X2 includes a flat spring 9. The web holder 6, which holds the cleaning web 5 to feed the cleaning web 5, is provided with the flat spring 9 having a simple configuration to apply pressure to the cleaning web 5 to prevent the cleaning web 5 from being wrinkled. With the flat spring 9, the cleaning mechanism 10X2 prevents the cleaning web 5 from being wrinkled. The flat spring 9 serves as a pressure applier that presses against the cleaning web 5 along a width direction thereof perpendicular to the direction X in which the cleaning web 5 is wound. That is, in FIG. 2, the flat spring 9 presses against an outer circumferential surface of the cleaning web 5 held by the web holder 6. As illustrated in FIG. 2, the flat spring 9 has a secured face 9*a* and a pressure face 9*b* that presses against the cleaning web 5.

Upon replacement of the cleaning web 5 with a new one, pressure from the flat spring 9 may hamper the replacement. Generally, upon replacement of the cleaning web 5, the web holder 6 is replaced with a new one. Since a new cleaning web 5 is wound around the new web holder 6, the new web holder 6 has an increased outer diameter. Therefore, an increased reaction force is applied to the flat spring 9 that presses against the new cleaning web 5, making it hard to hold the flat spring 9 manually or with a provisional jig.

To address this circumstance, a fixing device 1 of an image forming apparatus 100 includes a cleaning web unit 10 according to a first embodiment of the present disclosure.

Referring now to FIGS. 3 through 8, a description is given of the cleaning web unit 10 according to the first embodiment of the present disclosure.

With the cleaning web unit 10, the fixing device 1 addresses difficulty in incorporating a flat spring in a cleaning web mechanism due to pressure of the flat spring, facilitating replacement of a cleaning web.

Figure 3:
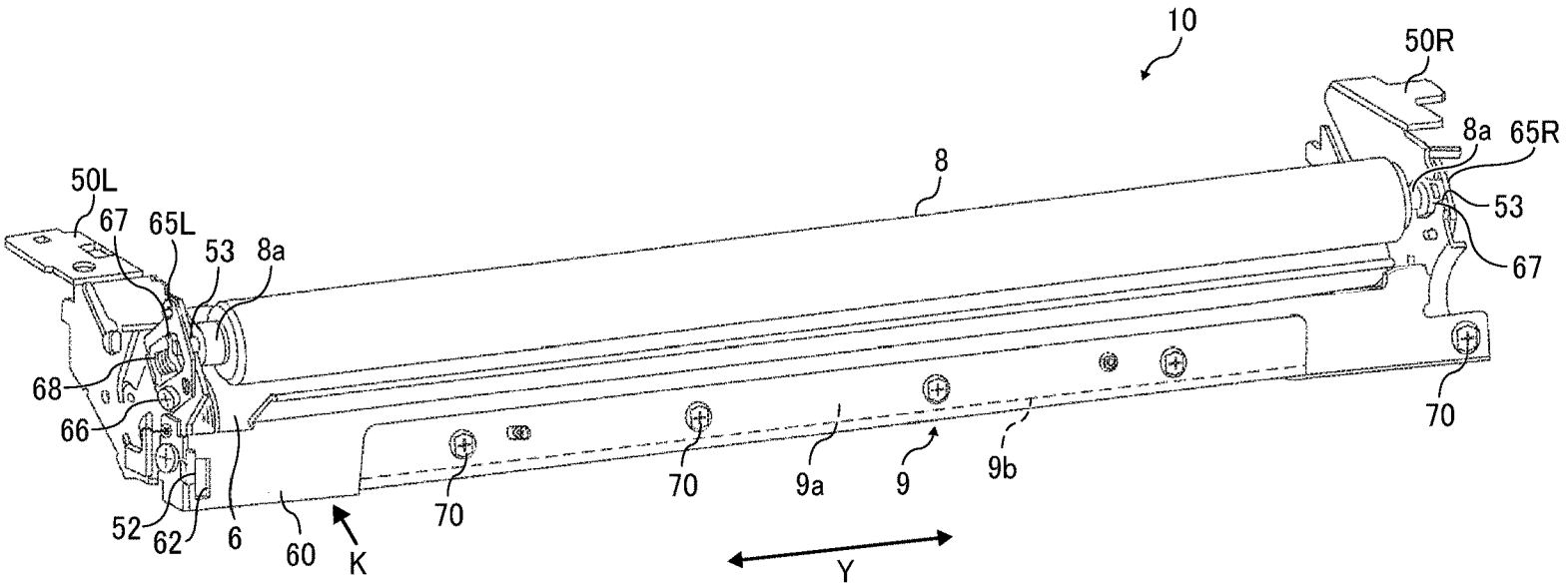
FIG. 3 is a front perspective view of a cleaning web unit according to a first embodiment.
Figure 4:
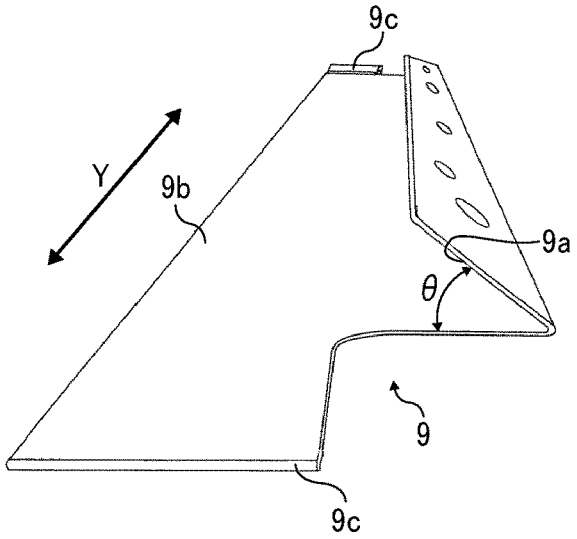
FIG. 4 is a perspective view of a flat spring before assembly.
Figure 5:
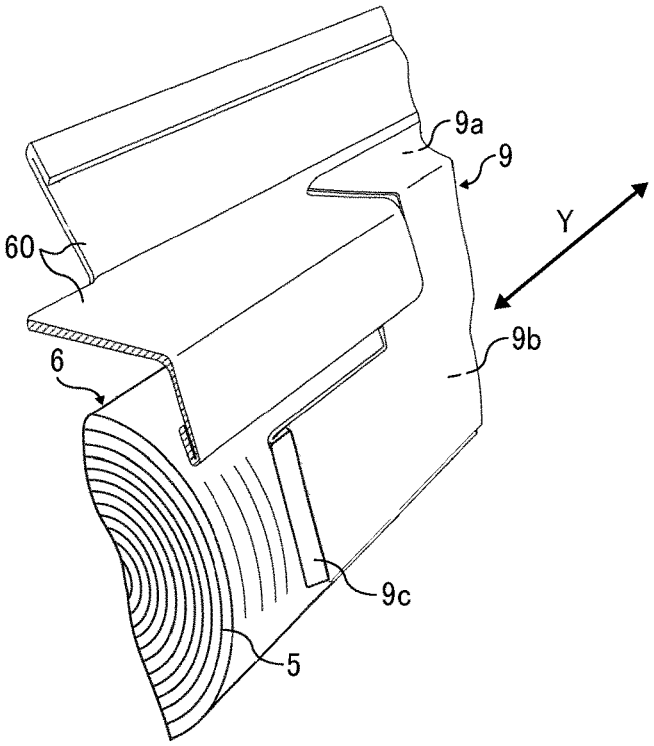
FIG. 5 is a perspective view of the flat spring and a holder frame seen in a direction K of FIG. 3, illustrating relative positions thereof upon assembly.

FIG. 3 is a front perspective view of the cleaning web unit 10. FIG. 4 is a perspective view of a flat spring 9 before assembly. FIG. 5 is a perspective view of the flat spring 9 and a holder frame 60 seen in a direction K of FIG. 3, illustrating relative positions thereof upon assembly. FIG.

Figure 6B:
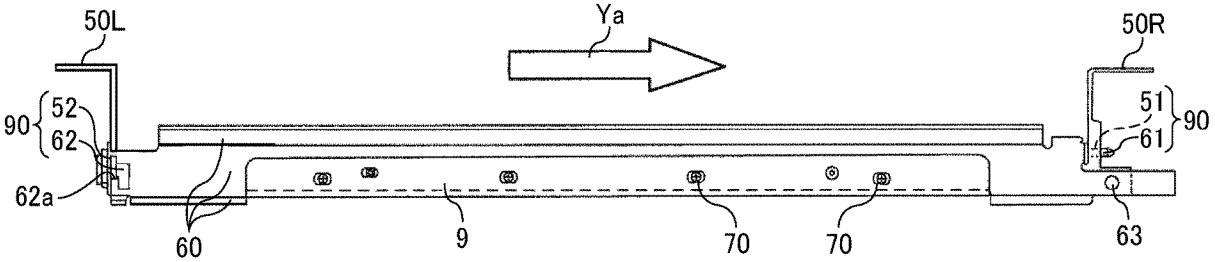
FIG. 6B is a front view of the cleaning web unit, illustrating that the flat spring temporarily held is ready to be coupled to a pair of frames via the holder frame.
Figure 7A:
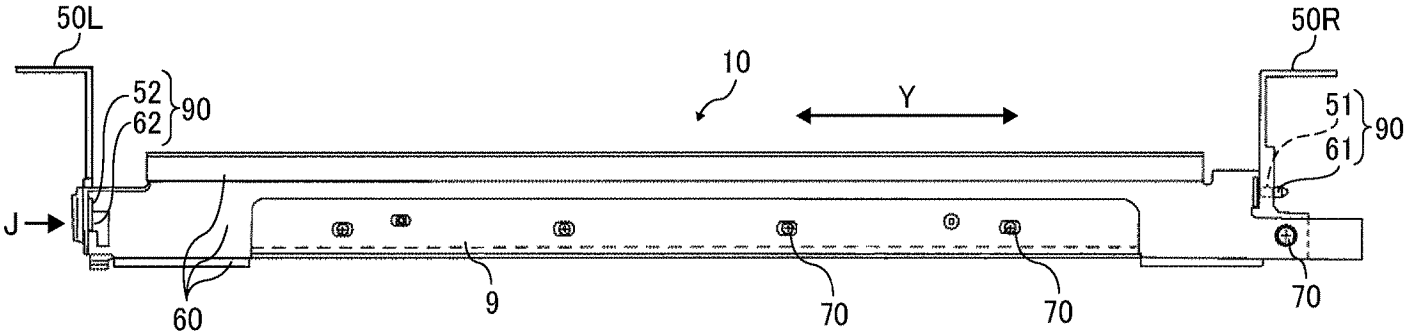
FIG. 7A is a front view of the cleaning web unit, illustrating the flat spring coupled to the pair of frames via the holder frame.
Figure 7B:
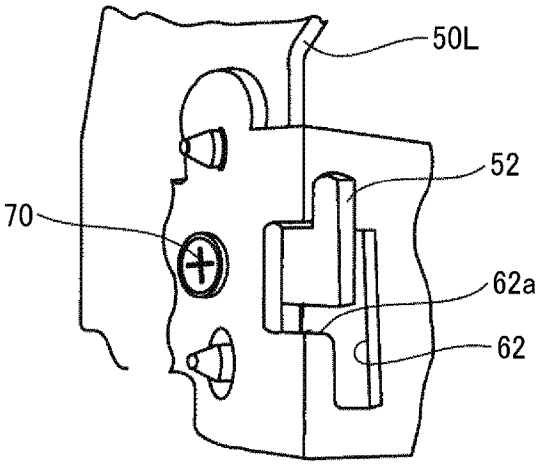
FIG. 7B is a partial perspective view of the cleaning web unit seen in a direction J of FIG. 7A.
Figure 8:
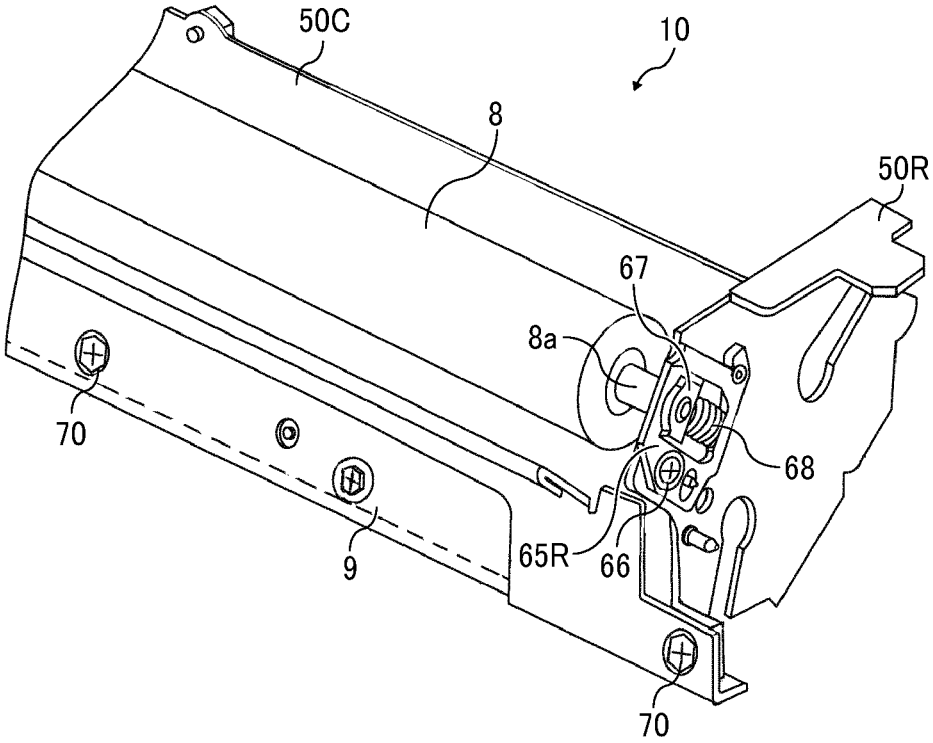
FIG. 8 is a back perspective view of the cleaning web unit.

6A is a front view of the cleaning web unit 10, illustrating a temporary holder 90 temporarily holding the flat spring 9 via the holder frame 60. FIG. 6B is a front view of the cleaning web unit 10, illustrating that the flat spring 9 temporarily held is ready to be coupled to a pair of frames 50 via the holder frame 60. FIG. 7A is a front view of the cleaning web unit 10, illustrating the flat spring 9 coupled to the pair of frames 50 via the holder frame 60. FIG. 7B is a partial perspective view of the cleaning web unit 10 seen in a direction J of FIG. 7A. FIG. 8 is a back perspective view of the cleaning web unit 10.

A cleaning mechanism as a cleaning device according to the first embodiment is different from the cleaning mechanism 10X2 of FIG. 2 in that the cleaning mechanism according to the first embodiment includes the cleaning web unit 10. Other than that, the cleaning mechanism according to the first embodiment is similar to the cleaning mechanism 10X2 of FIG. 2. Specifically, the cleaning mechanism (i.e., cleaning device) includes, e.g., the cleaning web 5, the web holder 6, the web roller 7, the cleaning pressure roller 8, and the flat spring 9. The cleaning web 5 slides over the surface of the fixing roller 2 to clean the surface of the fixing roller 2. The web holder 6 holds and sends out the cleaning web 5. The web roller 7 is a winder that winds the cleaning web 5. The cleaning pressure roller 8 is a cleaning pressure rotator that presses the cleaning web 5 against the fixing roller 2, thereby forming an area of contact, herein referred to as a web nip, between the cleaning web 5 and the fixing roller 2. The web holder 6 is provided with the flat spring 9 having a simple configuration to apply pressure to the cleaning web 5 to prevent the cleaning web 5 from being wrinkled. With the flat spring 9, the cleaning web unit 10 prevents the cleaning web 5 from being wrinkled. The flat spring 9 serves as a pressure applier that presses against the cleaning web 5 along a width direction thereof perpendicular to the direction X in which the cleaning web 5 is wound. That is, the flat spring 9 presses against an outer circumferential surface of the cleaning web 5 held by the web holder 6.

The cleaning web unit 10 includes a temporary holder 90 that temporarily holds the flat spring 9, a remover for the cleaning pressure roller 8, and a unit housing that supports, e.g., the web holder 6 and the cleaning pressure roller 8. It is to be noted that the unit housing is a device housing of the fixing device 1.

More specifically, as illustrated in FIG. 3, the cleaning web unit 10 includes, e.g., the pair of frames 50 as a unit housing (i.e., device housing), the web holder 6, the cleaning pressure roller 8 as a cleaning pressure rotator, the flat spring 9 as a pressure applier, and the holder frame 60 as a pressure holder. The pair of frames 50 is constructed of frames 50L and 50R.

The web holder 6 and the cleaning pressure roller 8 are rotatably supported between the frames 50L and 50R. Similarly, the web roller 7 is rotatably supported. A U-shaped groove 53 is formed in each of the frames 50L and 50R. A shaft 8*a* of the cleaning pressure roller 8 is fit into and removed from the groove 53.

The frame 50L is disposed on a first end portion of the cleaning web unit 10 in a width direction Y thereof, which is also a width direction of the cleaning web 5. Specifically, in FIG. 3, the frame 50L is a left end frame disposed on a left end portion of the cleaning web unit 10 in the width direction Y thereof. By contrast, the frame 50R is disposed on a second end portion of the cleaning web unit 10 in the width direction Y thereof. Specifically, in FIG. 3, the frame 50R is a right end frame disposed on a right end portion of the cleaning web unit 10 in the width direction Y thereof. A coupling frame 50C, partially illustrated in FIG. 8, couples the frames 50L and 50R. The frames 50L and 50R and the coupling frame 50C are formed as an integral metal plate, securing a certain rigidity.

Figure 6A:
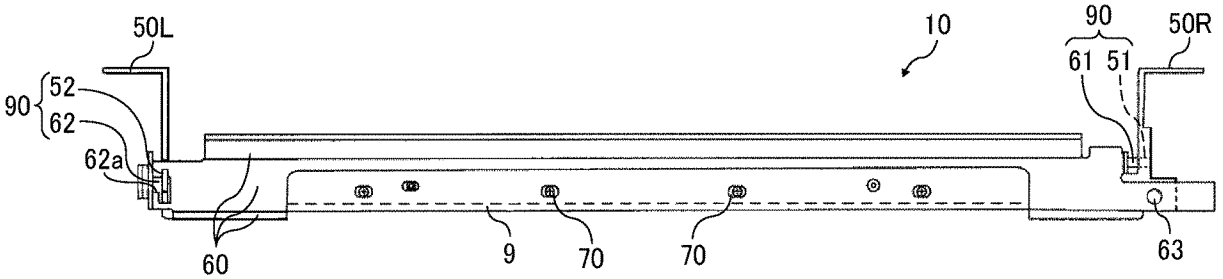
FIG. 6A is a front view of the cleaning web unit, illustrating a temporary holder temporarily holding the flat spring via the holder frame.

As illustrated in FIG. 6A, a convex portion 52 is formed in a lower portion of the frame SOL. By contrast, a through hole 51 is formed in the width direction Y in a lower portion of the frame 50R.

The flat spring 9 is a thin plate made of stainless steel, which is a metal elastic body, having a given thickness. As illustrated in FIG. 4, the flat spring 9 has the secured face 9*a* and the pressure face 9*b*. The secured face 9*a* is secured to the holder frame 60 in the cleaning web unit 10. The pressure face 9*b* presses against the cleaning web 5 on an outer circumferential surface of the web holder 6. As a single unit before assembly as illustrated in FIG. 4, the flat spring 9 is bent such that the secured face 9*a* and the pressure face 9*b* form an acute angle θ, which becomes about 48° immediately after replacement when the web holder 6 has a maximum outer diameter.

As illustrated in FIG. 5, when the flat spring 9 is incorporated in the cleaning web unit 10, the flat spring 9 presses against the cleaning web 5 on the outer circumferential surface of the web holder 6. In other words, the flat spring 9 is disposed to press against the cleaning web 5 held by the web holder 6, thereby generating a reaction force to prevent the cleaning web 5 from waving or being wrinkled with a maximum effectiveness.

Alternatively, if such a maximum effectiveness is an option, the flat spring 9 may be disposed so as to press against the cleaning web 5 at a position closer to the web holder 6 between the web holder 6 and the cleaning pressure roller 8.

When the flat spring 9 is disposed to press against the cleaning web 5 on the outer circumferential surface of the web holder 6 upon replacement of the cleaning web 5, the acute angle θ formed by the secured face 9*a* and the pressure face 9*b* increases compared to the acute angle θ before assembly. In other words, a bent portion of the flat spring 9 is forced to open as the flat spring 9 receives an increased reaction force from the cleaning web 5. Such an increased reaction force makes it hard to hold a flat spring in a typical cleaning mechanism. Especially, upon replacement of a cleaning web, a new web holder has a maximum outer diameter because a new cleaning web is wound around the new web holder. Therefore, an increased reaction force is applied to the flat spring that presses against the new cleaning web, making it hard to hold the flat spring, resulting in difficulty in incorporation of the flat spring in the typical cleaning mechanism.

As the cleaning web 5 on the outer circumferential surface of the web holder 6 is used, the outer diameter of the web holder 6 decreases to minimum. According to the first embodiment, the flat spring 9 is configured to press against the cleaning web 5 on the outer circumferential surface of the web holder 6 having a minimum outer diameter. A bent surface 9*c* of the flat spring 9 prevents the flat spring 9 from catching the cleaning web 5 when the flat spring 9 presses against the cleaning web 5.

As illustrated in FIG. 3, the flat spring 9 is secured at a predetermined position in a three-dimensional direction with master and slave reference pins and the secured face 9*a* that contacts a reference face of the holder frame 60, thus being fastened and secured to the holder frame 60 with four screws 70. The holder frame 60 is a metal plate appropriately bent, securing a certain rigidity.

In FIGS. 3 and 5, each of right and left end portions of the holder frame 60 includes a notch. With the notch, a pressure force caused by elasticity of the flat spring 9 is applied onto the cleaning web 5.

In FIG. 6A, the left end portion of the holder frame 60 includes a square hole 62 having a step portion. The square hole 62 is engageable with the convex portion 52 of the frame 50L. By contrast, the right end portion of the holder frame 60 includes a pin 61 and a hole 63 into which a screw is inserted. The pin 61 is, e.g., a rod insertable into the hole 51 of the frame 50R. The pin 61 projects outwards in the width direction Y.

Thus, the temporary holder 90 is constructed of the convex portion 52 of the frame 50L, the square hole 62 of the holder frame 60, the hole 51 of the frame 50R, and the pin 61 of the holder frame 60. When incorporating the flat spring 9 into the cleaning web unit 10 via the holder frame 60 upon replacement of the cleaning web 5, the temporary holder 90 temporarily holds the flat spring 9 in pressure contact with the cleaning web 5, thus securing the flat spring 9 to the frames 50L and 50R. The flat spring 9 is held by the holder frame 60 projecting beyond each end portion of the flat spring 9 in a width direction of the flat spring 9, that is, in the width direction Y.

Now, a description is given of operation of the temporary holder 90. On the right side in FIG. 6A, the pin 61 of the holder frame 60 is inserted into the hole 51 of the frame 50R. On the left side in FIG. 6A, the convex portion 52 of the frame 50L is engaged with the square hole 62 of the holder frame 60.

As described above, upon replacement of the web holder 6, a new web holder 6 has a maximum outer diameter because the new web holder 6 holds a new cleaning web 5. As illustrated in FIGS. 3 and 5, although the holder frame 60 constantly receives a reaction force from the new cleaning web 5 disposed on the new web holder 6 that receives an increased pressure force from the flat spring 9, the above-described construction prevents the holder frame 60 from moving out. Accordingly, the temporary holder 90 temporarily holds and secures the flat spring 9 to the frames 50L and 50R.

As illustrated in FIG. 6B, when the holder frame 60 is slid for a given distance in a width direction Ya of the cleaning web unit 10 from a state of FIG. 6A in which the flat spring 9 is temporarily held via the holder frame 60, the flat spring 9 can be coupled to the frames 50L and 50R via the holder frame 60 without receiving the reaction force, which is an influence of the pressure force of the flat spring 9. In short, FIG. 6B illustrates a coupling ready state in which the flat spring 9 can be coupled to the frames 50L and 50R via the holder frame 60.

In the state of FIG. 6B, the convex portion 52 of the frame 50L is engaged with and halted by an upper square hole 62*a* of the square hole 62 of the holder frame 60. The upper square hole 62*a* is the step portion of the square hole 62. Accordingly, without being influenced by the pressure force of the flat spring 9, the flat spring 9 can be coupled to the frames 50L and 50R via the holder frame 60.

In the state of FIG. 6B in which the flat spring 9 can be coupled to the frames 50L and 50R via the holder frame 60, the left and right end portions of the holder frame 60 are fastened and secured to the frames 50L and 50R, respectively, with the screws 70 as illustrated in FIG. 7A. FIG. 7A illustrates a coupling completion state in which coupling of the flat spring 9 to the frames 50L and 50R is completed.

In the coupling completion state, as illustrated in FIG. 7B, the left end portion of the holder frame 60 is secured at a predetermined position in the three-dimensional direction with master and slave reference pins of the frame 50L and a face of the holder frame 60 that contacts a reference face of the frame 50L.

As described above, according to the first embodiment, the temporary holder 90 temporarily holds the flat spring 9 when the flat spring 9 is incorporated into the cleaning web unit 10 upon replacement of the cleaning web 5. Accordingly, work efficiency is enhanced upon replacement of the cleaning web 5. Further, according to the first embodiment, working hours for the replacement is reduced compared to typical working hours for replacement of a cleaning web. As a consequence, operation cost can be reduced.

In the cleaning mechanism 10X2 of FIG. 2, a spring presses the cleaning pressure roller 8 against the fixing roller 2. That is, the spring and the cleaning pressure roller 8 are disposed inside the cleaning mechanism 10X2, occupying a certain space inside the cleaning mechanism 10X2. Such a construction makes it hard to replace the cleaning pressure roller 8 upon replacement of the cleaning web 5 or the cleaning pressure roller 8.

Referring now to FIGS. 3 and 8, a description is given of a removal mechanism that facilitates removal of the cleaning pressure roller 8 included in the cleaning web unit 10.

As illustrated in FIG. 3, a holder 65L is fastened and secured to the frame 50L via a screw 66. The holder 65L holds a first end portion of the shaft 8*a* of the cleaning pressure roller 8. As illustrated in FIG. 8, a holder 65R is fastened and secured to the frame 50R via another screw 66. The holder 65R holds a second end portion of the shaft 8*a* of the cleaning pressure roller 8.

The holder 65L accommodates a first bearing 67 and a first compression spring 68 inside the holder 65L. The first bearing 67 rotatably supports the first end portion of the shaft 8*a* of the cleaning pressure roller 8. The first compression spring 68 biases the first bearing 67 in a direction to press the cleaning pressure roller 8 toward the fixing roller 2. The holder 65R accommodates a second bearing 67 and a second compression spring 68 inside the holder 65R. The second bearing 67 rotatably supports the second end portion of the shaft 8*a* of the cleaning pressure roller 8. The second compression spring 68 biases the second bearing 67 in the direction to press the cleaning pressure roller 8 toward the fixing roller 2. Convex portions formed on opposed sides of the first bearing 67 are engaged with respective recessed portions formed opposite to each other inside the holder 65L. Thus, the first bearing 67 is supported movably with a biasing force of the first compression spring 68. Similarly, convex portions formed on opposed sides of the second bearing 67 are engaged with respective recessed portions formed opposite to each other inside the holder 65R. Thus, the second bearing 67 is supported movably with a biasing force of the second compression spring 68.

Each of the first and second end portions of the shaft 8*a* of the cleaning pressure roller 8 has a step portion. The first bearing 67 rotatably supports the step portion (i.e., smaller-diameter portion) of the first end portion of the shaft 8*a* of the cleaning pressure roller 8. Similarly, the second bearing 67 rotatably supports the step portion (i.e., smaller-diameter portion) of the second end portion of the shaft 8*a* of the cleaning pressure roller 8.

As illustrated in FIG. 3, the holder 65L is secured at a predetermined position in the three-dimensional direction with the master and slave reference pins of the frame 50L and the reference face of the frame 50L to which the holder 65L is secured, thus being fastened and secured to the frame 50L with the screw 66. Similarly, as illustrated in FIG. 8, the holder 65R is secured at a predetermined position in the three-dimensional direction with the master and slave reference pins of the frame 50R and a reference face of the frame 50R to which the holder 65R is secured, thus being fastened and secured to the frame 50R with the screw 66.

As described above, the holder 65L holds the first end portion of the shaft 8*a* of the cleaning pressure roller 8. By contrast, the holder 65R holds the second end portion of the shaft 8*a* of the cleaning pressure roller 8. The holders 65L and 65R are independently disposed. Specifically, the holders 65L and 65R are disposed symmetrically about a center line in a width direction of the cleaning pressure roller 8, that is, in the width direction Y.

When the screw 66 is removed, the holder 65 is removed from the frame 50. For example, when the screw 66 that secures the holder 65L to the frame 50L is removed, the holder 65L is removed from the frame 50L. Thereafter, when the first end portion of the shaft 8*a* of the cleaning pressure roller 8 is drawn from the U-shaped groove 53 of the frame 50L upper leftward in FIG. 3, the second end portion of the shaft 8*a* of the cleaning pressure roller 8 is easily removed from the holder 65R secured to the frame 50R. Similarly, when the holder 65R is removed from the frame 50R first, the first end portion of the shaft 8*a* of the cleaning pressure roller 8 is easily removed from the holder 65L secured to the frame 50L.

Thus, according to the first embodiment, the holder 65L holding and securing the first end portion of the shaft 8*a* of the cleaning pressure roller 8 and the holder 65R holding and securing the second end portion of the shaft 8*a* of the cleaning pressure roller 8 are independently disposed at the first end portion of the cleaning pressure roller 8 and the second end portion of the cleaning pressure roller 8, respectively. Accordingly, work efficiency is enhanced upon replacement of the cleaning pressure roller 8. Further, working hours for the replacement is reduced compared to typical working hours for replacement of a cleaning pressure roller. As a consequence, operation cost can be reduced.

Figure 9:
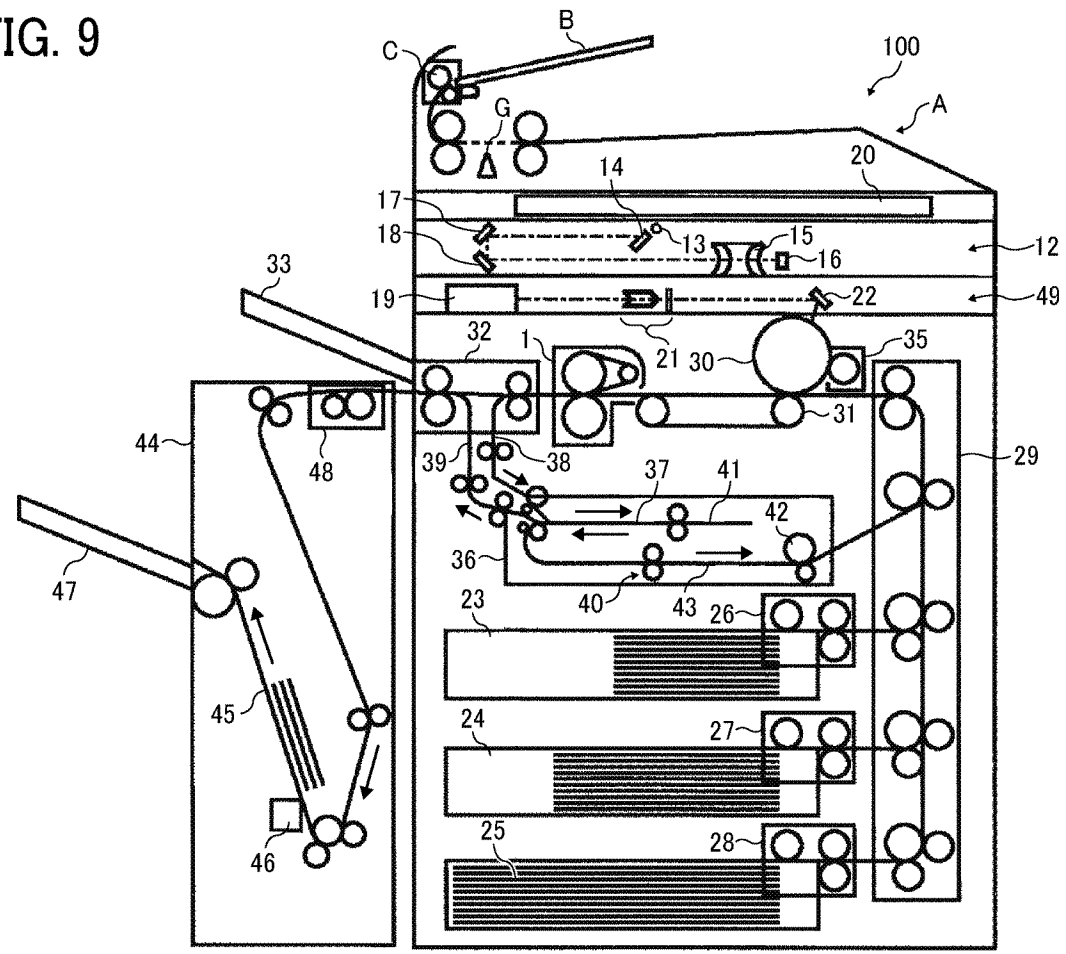
FIG. 9 is a schematic view of an image forming apparatus according to an embodiment of the present disclosure.

Referring now to FIG. 9, a description is given of the image forming apparatus 100 incorporating the fixing device 1 to which the embodiments of the present disclosure are applied.

FIG. 9 is a schematic view of the image forming apparatus 100 according to an embodiment of the present disclosure.

In FIG. 9, the scanner 12 scans a document placed on a pressure plate. The scanner 12 includes an exposure glass 20 and an optical scanning system. The document is placed on the exposure glass 20. The optical scanning system includes, e.g., an exposure lamp 13, a first mirror 14, a second mirror 17, a third mirror 18, a lens 15, and a charge-coupled device (CCD) image sensor 16. The CCD image sensor 16 reads an image of the document. The image of the document is converted to an electrical signal and processed.

The image forming apparatus 100 includes an automatic document reader A to automatically read a sheet document. A sheet feeding roller C feeds the document placed on a document tray B to a position where the document meets a document sensor G. The document sensor G reads an image on a front side of the document passing before the document sensor G at a given speed. Data of the image thus read by the document sensor G is subjected to image processing such as various types of correction and compression. The image data thus processed is sequentially stored in an image memory.

A writing unit 49 includes, a laser output unit 19, an imaging lens 21, and a mirror 22. The writing unit 49 irradiates a photoconductor 30 with a laser beam. On the photoconductor 30, a toner image is formed. In other words, the photoconductor 30 is an image bearer that bears a toner image.

To provide a fuller understanding of the embodiments of the present disclosure, a description is now given of an image forming operation of the image forming apparatus 100 to print the image formed on the photoconductor 30, with continued reference to FIG. 9.

A first sheet feeder 26, a second sheet feeder 27, and a third sheet feeder 28 feed a plurality of sheets S (i.e., recording media) resting on a first tray 23, a second tray 24, and a third tray 25, respectively, one by one to a vertical conveyance unit 29. The vertical conveyance unit 29 feeds the sheet S to a position before the photoconductor 30.

The writing unit 49 irradiates the photoconductor 30 with the laser beam to form a latent image on the photoconductor 30 according to the image data retrieved from the image memory. A developing device 35 develops the latent image with toner, rendering the latent image visible as a toner image. Thus, the toner image is formed on the photoconductor 30.

While the sheet S is conveyed on a conveyor belt 31 at the same speed as a rotational speed of the photoconductor 30 in synchronization with movement of the toner image thus formed on the photoconductor 30, the toner image is transferred onto the sheet S from the photoconductor 30. Subsequently, the sheet S bearing the toner image is conveyed to the fixing device 1 in a direction of conveyance of the sheet S as a recording medium conveyance direction. The fixing device 1, disposed downstream from the photoconductor 30 in the direction of conveyance of the sheet S, fixes the toner image onto the sheet S. A sheet ejection unit 32 outputs the sheet S bearing the fixed toner image onto, e.g., a first output tray 33.

Upon duplex printing to form images on both sides of the sheet S, the sheet ejection unit 32 switches a reverse passage switching claw to convey the sheet S, fed from one of the first through third trays 23 through 25 and bearing the toner image on a front side, to a duplex printing passage 38, instead of directing the sheet S to the first output tray 33. The sheet S is conveyed along the duplex printing passage 38 to a reverse unit 37 in a duplex printing conveyance unit 36. Then, the sheet S is halted on a switchback conveyance passage 41. A switchback conveyor sends out the sheet S in a reverse direction (i.e., re-feeding direction). A reverse sheet-ejection switching claw directs the sheet S downwards to reverse the sheet S. The sheet S thus reversed is conveyed to an intermediate conveyance passage 43 located below the reverse sheet-ejection switching claw. Then, an intermediate conveyor 40 and an exit conveyor 42, each of which is connected to a drive source, send the sheet S to the vertical conveyance unit 29. The sheet S is conveyed through the vertical conveyance unit 29 again to reach the fixing device 1 where another toner image is fixed onto a back side of the sheet S. Then, the sheet S bearing the images on both sides is ejected from a housing of the image forming apparatus 100.

To reverse and eject the sheet S, the reverse unit 37 reverses the sheet S and directs the sheet S to a sheet ejection conveyance passage 39 with the reverse sheet-ejection switching claw, instead of directing the sheet S to the intermediate conveyance passage 43. The sheet S is conveyed along the sheet ejection conveyance passage 39 to the sheet ejection unit 32, which ejects the sheet S from the housing of the image forming apparatus 100.

The sheet S is ejected from the sheet ejection unit 32 onto the first output tray 33 or to a finisher 44 with a sheet ejection switching claw. The sheet S entering the finisher 44 passes through a punch unit 48 that pierces the sheet S. Then, the sheet S temporarily rests on a stack tray 45 for stapling.

After a bunch of sheets S rests on the stack tray 45, a stapler 46 staples the bunch of sheets S. Then, the stapled bunch of sheets S is ejected onto a second output tray 47.

A description is given of advantages of the fixing devices 1 according to the embodiment described above.

A fixing device (e.g., fixing device 1) includes a fixing rotator (e.g., fixing roller 2), a pressure rotator (e.g., pressure roller 3), and a cleaning device (e.g., cleaning web unit 10). The pressure rotator contacts the fixing rotator to form a fixing nip between the fixing rotator and the pressure rotator, through which a recording medium (e.g., sheet S) bearing a toner image is conveyed. The cleaning device cleans a surface of at least one of the fixing rotator and the pressure rotator. The cleaning device includes a cleaning web (e.g., cleaning web 5), a web holder (e.g., web holder 6), a winder (e.g., web roller 7), a cleaning pressure rotator (e.g., cleaning pressure roller 8), a pressure applier (e.g., flat spring 9), and a temporary holder (e.g., temporary holder 90). The cleaning web slides over the at least one of the fixing rotator and the pressure rotator to clean the surface of the at least one of the fixing rotator and the pressure rotator. The web holder holds and sends out the cleaning web. The winder winds the cleaning web. The cleaning pressure rotator presses the cleaning web against the at least one of the fixing rotator and the pressure rotator. The pressure applier presses against the cleaning web along a width direction of the cleaning web perpendicular to a direction in which the cleaning web is wound, thereby preventing the cleaning web from being wrinkled. The temporary holder temporarily holds the pressure applier upon incorporation of the pressure applier into the cleaning device.

According to the embodiments described above, work efficiency is enhanced upon replacement of the cleaning web.

The fixing device 1 incorporating the cleaning web unit 10 described above employs a heating roller system provided with a fixing roller (e.g. fixing roller 2) and a pressure roller (e.g., pressure roller 3). For example, as illustrated in FIGS. 1 and 2, the fixing roller 2 serves as a fixing rotator. Inside the fixing rotator, a heater (e.g., heater 2*a*) may be disposed. Alternatively, the cleaning web unit according to the embodiments of the present disclosure can be incorporated into a fixing device provided with a fixing belt as illustrated in FIG. 9, for example. In this case, the fixing belt serves as a fixing rotator.

The component cleaned by the cleaning web device or mechanism (e.g., cleaning web unit 10) according to the embodiment of the present disclosure is not limited to a fixing rotator (e.g., fixing roller 2). Alternatively, the cleaning web device or mechanism may clean a pressure rotator (e.g., pressure roller 3). Alternatively, the cleaning web device or mechanism may clean both the fixing rotator and the pressure rotator.

The image forming apparatus 100 may be a copier, a facsimile machine, a printer, a multifunction peripheral or multifunction printer (MFP) having at least one of copying, printing, scanning, facsimile, and plotter functions, or the like.

Although the present disclosure makes reference to specific embodiments, it is to be noted that the present disclosure is not limited to the details of the embodiments described above and various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A fixing device comprising:

a fixing rotator;

a pressure rotator configured to contact the fixing rotator to form a fixing nip between the fixing rotator and the pressure rotator, through which a recording medium bearing a toner image is conveyed; and a cleaning device configured to clean a surface of at least one of the fixing rotator and the pressure rotator, the cleaning device including:

a device housing;

a cleaning web configured to slide over the at least one of the fixing rotator and the pressure rotator to clean the surface of the at least one of the fixing rotator and the pressure rotator;

a web holder configured to hold and send out the cleaning web;

a winder configured to wind the cleaning web;

a cleaning pressure rotator configured to press the cleaning web against the at least one of the fixing rotator and the pressure rotator;

a pressure applier configured to press against the cleaning web along a width direction of the cleaning web perpendicular to a direction in which the cleaning web is wound;

a pressure holder, projecting beyond an end portion of the pressure applier in a width direction of the pressure applier parallel to the width direction of the cleaning web, configured to hold the pressure applier; and a temporary holder configured to temporarily hold the pressure applier, wherein the temporary holder comprises, a square hole formed in a first end portion of the pressure holder and having a step portion, a convex portion formed in the device housing and engageable with the square hole, a rod formed in a second end portion of the pressure holder and projecting in a width direction of the pressure holder parallel to the width direction of the cleaning web, and a hole, formed in the device housing, into which the rod is insertable.

2. The fixing device according to claim 1, further comprising a heater disposed inside the fixing rotator.

3. The fixing device according to claim 1, wherein the fixing rotator is one of a roller and a belt.

4. The fixing device according to claim 1, wherein the pressure applier is a flat spring made of metal.

5. The fixing device according to claim 1, wherein the pressure applier is disposed to press against the cleaning web held by the web holder.

6. The fixing device according to claim 1, wherein the pressure holder is configured to move for a given distance in the width direction of the pressure holder to be coupled to the device housing.

7. The fixing device according to claim 1, wherein the cleaning device further includes:

a first holder holding a first end portion of the cleaning pressure rotator; and a second holder holding a second end portion of the cleaning pressure rotator, and wherein the first holder and the second holder are independently disposed at the first end portion of the cleaning pressure rotator and the second end portion of the cleaning pressure rotator, respectively.

8. An image forming apparatus comprising:

an image bearer to bear a toner image; and the fixing device according to claim 1, the fixing device being disposed downstream from the image bearer in a recording medium conveyance direction to fix the toner image onto a recording medium.

* * * * *